US007986333B2

(12) United States Patent
Abe et al.

(10) Patent No.: US 7,986,333 B2
(45) Date of Patent: Jul. 26, 2011

(54) RECORDING DEVICE

(75) Inventors: Yoshibumi Abe, Fukushima-ken (JP); Eihin Setsu, Fukushima-ken (JP)

(73) Assignee: ALPS Electric Co., Ltd., Tokyo (JP)

( * ) Notice: Subject to any disclaimer, the term of this patent is extended or adjusted under 35 U.S.C. 154(b) by 44 days.

(21) Appl. No.: 12/544,698

(22) Filed: Aug. 20, 2009

(65) Prior Publication Data

US 2010/0045764 A1 Feb. 25, 2010

(30) Foreign Application Priority Data

Aug. 21, 2008 (JP) ..... 2008-212897

(51) Int. Cl.
*B41J 25/312* (2006.01)

(52) U.S. Cl. ..... 347/198

(58) Field of Classification Search ..... 347/197, 347/198; 400/120.16, 120.17
See application file for complete search history.

(56) References Cited

U.S. PATENT DOCUMENTS 5,317,337 A * 5/1994 Ewaldt ..... 347/2
5,542,768 A * 8/1996 Rother et al. ..... 400/120.16
6,148,722 A * 11/2000 Hagstrom ..... 101/35
6,264,295 B1 * 7/2001 Bradshaw et al. ..... 347/2
6,302,601 B1 * 10/2001 Hagstrom et al. ..... 400/283
6,312,174 B1 * 11/2001 Drynkin et al. ..... 400/120.16
6,447,181 B1 * 9/2002 Hagstrom et al. ..... 400/120.01

FOREIGN PATENT DOCUMENTS

JP 2005-190645 7/2005
JP 2007-188590 7/2007
WO WO 00/12314 * 3/2000

* cited by examiner

*Primary Examiner* — Huan H Tran
(74) *Attorney, Agent, or Firm* — Hunton & Williams, LLP

(57) ABSTRACT

A recording device presses a thermal head, where heating elements are arranged in a direction orthogonal to a transport direction of the print medium, against a printing surface of the print medium at a printing portion on a transport path of a print medium transported by a transport means, controls the flow of current selectively applied to the heating elements, and performs desired printing at a printing area on the printing surface. The print medium has a shape having portions where the contact lengths of the printing surface coming in contact with the heating elements in a width direction orthogonal to a transport direction of the print medium are different in the transport direction. A pressing load of the thermal head is frequently adjusted according to the contact length of the printing surface of the print medium.

3 Claims, 6 Drawing Sheets

RECORDING DEVICE

CROSS REFERENCE TO RELATED APPLICATIONS

The present invention contains subject matter related to and claims the benefit of Japanese Patent Application No. 2008-212897 filed in the Japanese Patent Office on Aug. 21, 2008, the entire contents of which is incorporated herein by reference.

BACKGROUND OF THE DISCLOSURE

1. Technical Field

The present invention relates to a recording device for printing a desired image on a recording medium of which a printing surface has shapes except for a rectangular shape, that is, different shapes, and more particularly, to a recording device that prints a desired image on a label surface of a circular optical disk used as a recording medium.

2. Related Art

In recent years, an original music album, a photographic album, a DVD album, and the like could be easily made by using an optical disk drive (hereinafter, referred to as an ODD) corresponding to an optical disk (hereinafter, referred to as an optical disk) used as a recording medium, such as a CD-R (Compact Disk Recordable), a DVD-R (Digital Versatile Disk Recordable), a CD-RW (Compact Disk ReWritable), or a DVD-RW (Digital Versatile Disk ReWritable). For this reason, there is a demand for the printing of a label of the made optical disk with an original design.

Accordingly, in the past, there has been proposed a recording device that can print an image of a desired label on a printable area of a printing surface of an optical disk (see, e.g., Japanese Unexamined Patent Application Publication No. 2007-188590, inkjet line printer).

If the recording device is a thermal transfer recording device using a thermal head where a plurality of heating elements are linearly arranged, regardless of whether an ink ribbon is used, an optical disk is transported to the downstream side from the upstream side in a transport direction, a pressing load is applied to the thermal head so that the thermal head comes in contact with the optical disk, and current is selectively applied to the heating elements.

In this case, a pressing load, which is applied to the thermal head, has been made constant by using the elasticity of a spring. For this reason, if recording is performed on a circular optical disk having a predetermined thickness, the linear contact length of the printing surface of the optical disk coming in contact with the thermal head is short when the thermal head comes in contact with a circumferential portion of the optical disk, that is, front and rear end portions of the optical disk in a transport direction (directly before recording begins to be performed or is terminated). Accordingly, extreme pressure or high contact pressure (linear pressure) is applied to the contact portion. In contrast, when the thermal head comes in contact with a portion of the optical disk that is close to the diameter of the optical disk (while recording is being performed), the linear contact length is longest. Therefore, contact pressure is lowered. Specifically, there has been known that contact pressure is changed tenfold or more between when the recording begins to be performed and when recording is being performed. The change in contact pressure during a series of recording causes a disadvantage, such as color unevenness generated on a recording result.

SUMMARY OF THE DISCLOSURE

An advantage of various embodiments is to provide a recording device that can keep the contact pressure substantially constant even though the linear contact length of a recording medium coming in contact with a thermal head is changed, thereby obtaining good recording results on printing surfaces having different shapes.

According to an exemplary embodiment, a recording device presses a thermal head, where heating elements are arranged in a direction orthogonal to a transport direction of the print medium, against a printing surface of the print medium at a printing portion on a transport path of a print medium transported by a transport means, controls the flow of current selectively applied to the heating elements, and performs desired printing at a printing area on the printing surface. The print medium has a shape having portions where the contact lengths of the printing surface coming in contact with the heating elements in a width direction orthogonal to a transport direction of the print medium are different in the transport direction. A pressing load of the thermal head is frequently adjusted according to the contact length of the printing surface, which comes in contact with the heating elements, of the print medium to be transported to the printing portion.

A recording device according to various embodiments, which has the above-mentioned structure, can keep contact pressure substantially constant even though the linear contact length of a recording medium coming in contact with a thermal head is changed. Therefore, the recording device can obtain good recording results on printing surfaces having different shapes.

Furthermore, the print medium may be a circular optical disk, and the printing surface of the print medium may have a circular shape that is concentric with the print medium.

Furthermore, the exemplary recording devices may be integrally formed with an optical disk drive mechanism and print a desired image on a label surface of an optical disk that is transported by a transport means provided in the optical disk drive mechanism.

As described above, even though the contact length of a recording medium coming in contact with heating elements of a thermal head is changed, the recording device according to various embodiments can keep contact pressure substantially constant. Therefore, it may be possible to obtain good recording results on printing surfaces having different shapes.

BRIEF DESCRIPTION OF THE DRAWINGS

FIG. 5 is a view showing the structure of a cam gear of the recording device according to an embodiment of the disclosure, wherein

DESCRIPTION OF EXEMPLARY EMBODIMENTS

The following description is intended to convey a thorough understanding of the embodiments described by providing a number of specific embodiments and details involving recording devices. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

A recording device 1 according to various embodiments is integrally formed with an optical disk drive mechanism (not shown). The optical disk drive mechanism may transport an optical disk D used as a recording medium having a shape having portions, where the dimensions of a printing surface in a direction (width direction) orthogonal to a transport direction of the recording medium are different from each other in the transport direction, in a slot-in manner.

Figure 1:
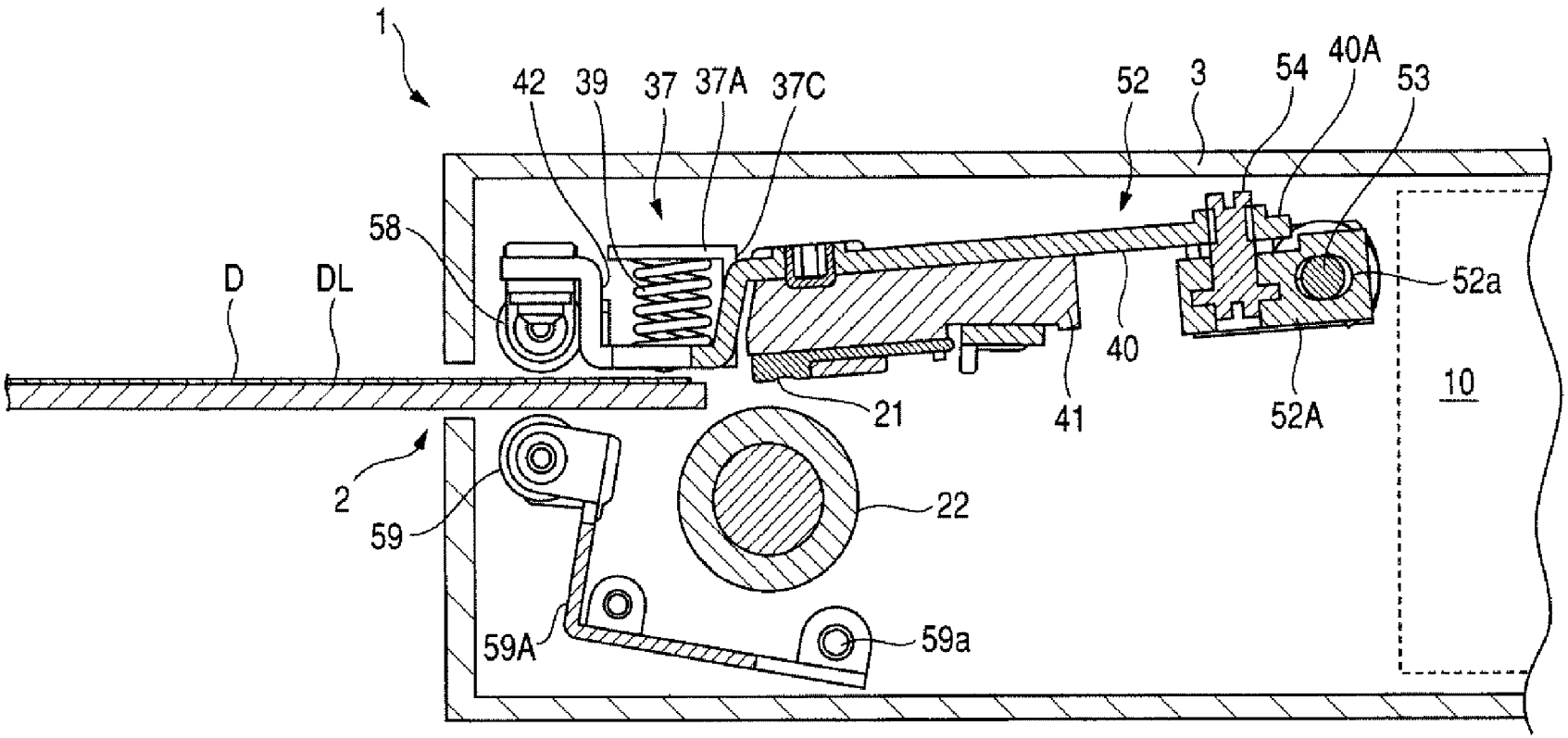
FIG. 1 is a cross-sectional view of main parts of a recording device according to an embodiment of the disclosure.

Specifically, the recording device 1 may include a thin case 3. A slot 2, which may be used for the insertion and discharge of the optical disk D, may be formed at the front surface of the case as shown in FIG. 1. A display section that may display the state of the access to the optical disk D by lighting, an eject button that may be pressed at the time of the discharge of the optical disk D, and the like (not shown) may be provided on the front surface of the case 3.

A so-called slot-in type optical disk drive mechanism having known structure may be provided in the case 3 on the inner side of the front surface. The recording device 1 may be provided on the transport path of the optical disk D between the optical disk drive mechanism and the slot 2 corresponding to the front side of the case. Meanwhile, a control board (not shown), which may be common to the optical disk drive mechanism and the recording device 1, is provided on the bottom of the case in the case 3 so as to be capable of performing data communication.

The optical disk drive mechanism may include an optical disk loading unit on which the optical disk D inserted from the slot 2 may be loaded, a sensor that can detect the presence or absence of the optical disk D loaded on the optical disk loading unit and the size of the optical disk D, an optical disk rotating drive mechanism that rotationally drives the optical disk D loaded on the optical disk loading unit, a pickup mechanism that writes and/or reads out a signal onto/from the optical disk D rotationally driven by the optical disk rotating drive mechanism, and a pickup feed mechanism that moves the pickup mechanism over the inner and outer peripheries of the optical disk D. Furthermore, the optical disk drive mechanism may include an optical disk transport mechanism. The optical disk transport mechanism may perform a loading operation that draws the optical disk U into the case 3 from the slot 2 and transports the optical disk to the optical disk loading unit, and an ejecting operation that may discharge the optical disk D to the outside of the case 3 through the slot 2. Furthermore, the optical disk drive mechanism can deal with an optical disk D having a diameter of 12 cm that is a standard size (hereinafter, sometimes referred to as a large-diameter optical disk) and an optical disk D having a diameter of 8 cm that is smaller than the diameter of the large-diameter optical disk (hereinafter, sometimes referred to as a small-diameter optical disk). Meanwhile, the detailed description of the optical disk drive mechanism will be omitted, but the structure of an optical disk drive mechanism disclosed in, for example, Japanese Unexamined Patent Application Publication No. 2005-190645, the contents of which is incorporated herein by reference, may be exemplified.

Moreover, the recording device 1 may print a desired image on a label surface DL, which may be a printing surface of the optical disk D, by using the optical disk transport mechanism of the optical disk drive mechanism 10 as a transport means for transporting the optical disk D that is used as a recording medium. The recording device may include a thermal head 21 and a platen 22. The thermal head faces the label surface DL so as to be capable of approaching and being separated from the label surface, and includes heating elements. The heating elements may be linearly arranged so as to correspond to the length that is equal to or larger than the maximum printing diameter of the largest optical disk D to be loaded on the optical disk loading unit. The platen may be disposed so that the transport path of the optical disk D is positioned between the thermal head 21 and the platen.

In detail, a pair of side plates 23, which may face each other with a predetermined gap therebetween, may be provided in the case 3. The platen 22, where shaft portions 27 protrude from the ends of a long and cylindrical roller portion 26 in the longitudinal direction of the roller portion, may be supported between the side plates 23 near the slot 2 through the shaft portions 27.

In more detail, shaft holes (not shown) having a large diameter may be formed at the pair of side plates 23, respectively. Shaft-like protrusions 51, which may be formed at cam gears 50 to be described below and have a large diameter, may be fitted to the shaft holes, respectively, so that the cam gears 50 are rotatably supported. The cam gears 50 make a pair, and a shaft hole 50*a* may be formed at the shaft-like protrusion 51 of each of the cam gears 50 so as to be out of the center of rotation of the cam gear 53. The end of each of the shaft portions 27 of the platen 22 may be inserted into the shaft hole 50*a*. The structure of the cam gear 50 will be described below. The shaft portions 27 of the platen 22 may be journaled to the shaft holes 50*a* that are formed at the cam gears 50 rotatably provided at the side plates 23. Accordingly, the platen 22 may be supported between the pair of side plates 23 so as to be rotated in accordance with the rotation of the cam gears 50.

Moreover, as shown in FIG. 1, a head lever unit 52 including a long plate-like head lever 40 may be provided above the platen 22. The linear thermal head 21, where a plurality of heating elements (not shown) are arranged in the longitudinal direction so as to face the platen 22, is positioned at the head lever.

The head lever unit 52 may be provided so that the head lever 40 extends in a horizontal direction orthogonal to the longitudinal direction of the side plate 23. A shaft 53 may be inserted into a shaft hole 52*a* formed at a base 52A, so that the head lever unit 52 may be journaled to the base. Accordingly, the head lever unit may be supported so that the side of the head lever unit corresponding to the slot 2 is rotated as an opened end.

An upward screw member 54 may be rotatably supported by the base 52A, and a base end portion 40A extending from a middle portion of the rear side of the head lever 40 may be threadedly engaged with the screw member 54. Accordingly, when the screw member 54 is rotated, the rear side of the head lever 40 may be moved up. As a result, it may be possible to adjust the angle of the head lever 40 with respect to the horizontal direction.

Meanwhile, in various embodiments, the shaft hole 52*a* formed at the base 52A may be formed of a long hole of which the dimension in the thickness direction of the base 52A may be the diameter of the shaft 53 and the dimension in a direction orthogonal to the thickness direction is larger than the diameter of the shaft 53. Accordingly, the base 52A may be rotated about the shaft 53 and slide with respect to the shaft 53. Furthermore, protruding pieces 402 having engagement holes 40*b*, where engagement pins (not shown) protruding from the side plates 23 toward the inside of the case 3 are engaged, may be formed at both side portions of the rear side of the head lever 40 where the base end portion 40A is formed, so as to protrude rearward like the base end portion 40A. The engagement hole 40*b* may be formed of a long hole so that the position of the engagement pin may be changed in accordance with the upward or downward movement of the base end portion of the head lever 40. The engagement pin engaged with the engagement hole 40*b* may function as a pivot of the head lever 40.

A thermal head mounting base 41 may be fixed to the lower surface of the head lever 40, and the thermal head 21 may be fixed to the lower surface of the thermal head mounting base 41. Recesses 42 may be formed at the head lever 40 on the front side of the mounting position of the thermal head mounting base 41. Coil springs 39 (erg., four coil springs arranged at regular intervals) may be provided in the recesses 42. The upper portions of the coil springs may come in contact with the lower surface of a plate body 37A of a plate-like spring plate 37 that may be provided on the head lever 40 so as to cover the opened upper sides of the recesses 42, and the coil springs push down the thermal head 21 by the elastic force thereof.

Furthermore, the platen 22, which makes the optical disk D be pinched between the thermal head 21 and the platen, may be provided below the thermal head 21 so as to be rotatable in the transport direction of the optical disk D.

Furthermore, upper holding rollers 58 for holding the optical disk D may be supported on the front side of the recesses 42 of the head lever 40 so as to be rotatable in the transport direction of the optical disk D. The upper holding rollers 58 may be separated from the optical disk D when printing is performed by the thermal head 21. Additionally, lower holding rollers 59, which can pinch the optical disk D together with the upper holding rollers 58, are provided below the upper holding rollers 58. The lower holding rollers 59 may be rotatably supported at the front end portions of bell crank-like support arm 59A, and the base end portions of the support arm 59A may be rotatably supported by support shafts 59*a*. Furthermore, cam roller pins 59*b* for roller, which protrude outward, may be provided at both ends of the support arm 59A in the longitudinal direction of the support arm. The cam roller pins 59*b* for roller may be engaged with cam grooves 50*c* for roller that may be formed at a pair of cam gears 50 to be described below. When the cam roller pins for roller slide in the cam grooves 50*c* for roller in accordance with the rotation of the cam gears 50, the support arm 59A may be swung while being linked to the pressing (head-down)/separation (head-up) operation of the thermal head 21. Accordingly, the support arm 59A may be moved so that the lower holding roller 5B is pressed against or separated from the upper holding roller 59.

Figure 2:
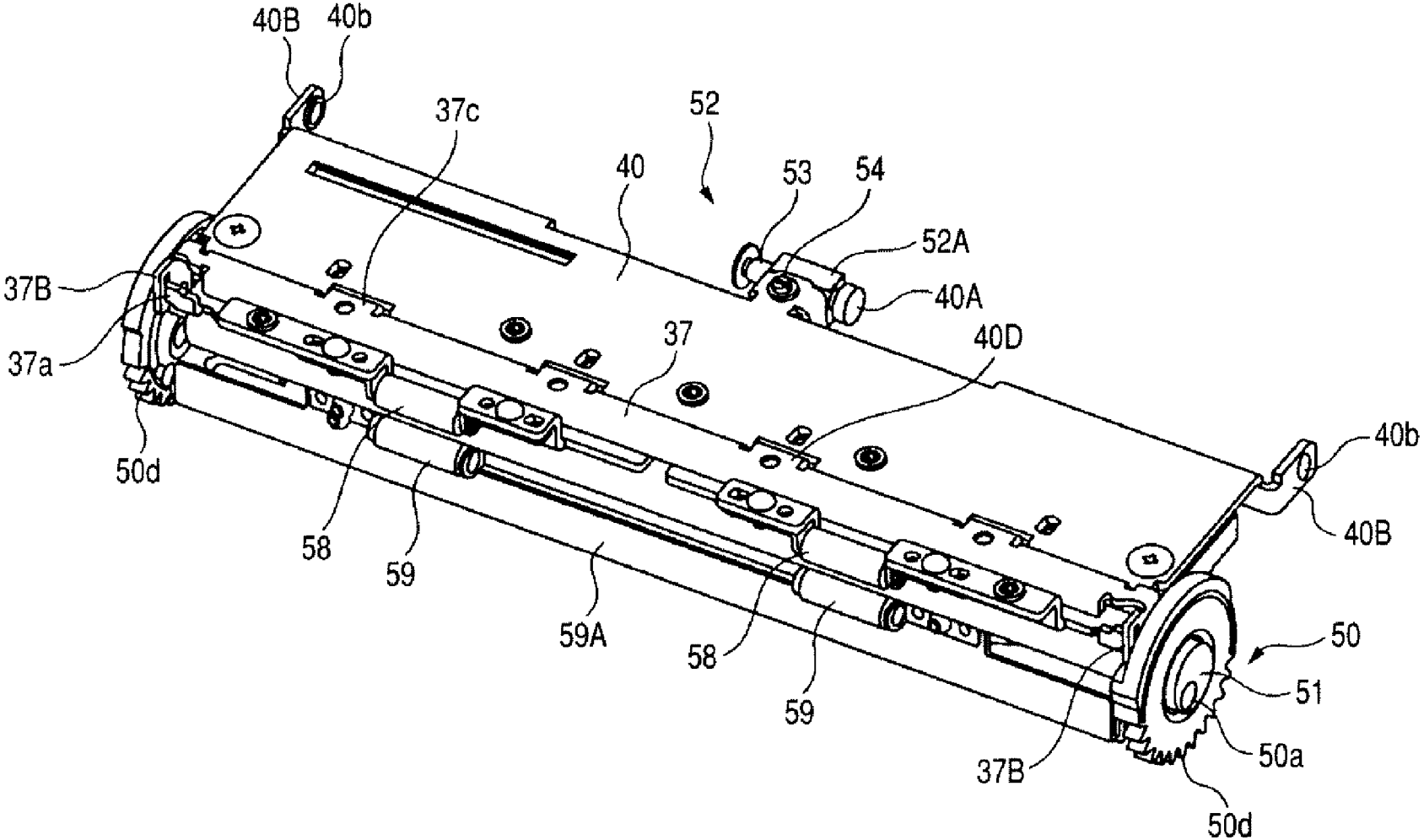
FIG. 2 is a perspective view of main parts of the recording device according to an embodiment of the disclosure.
Figure 3:
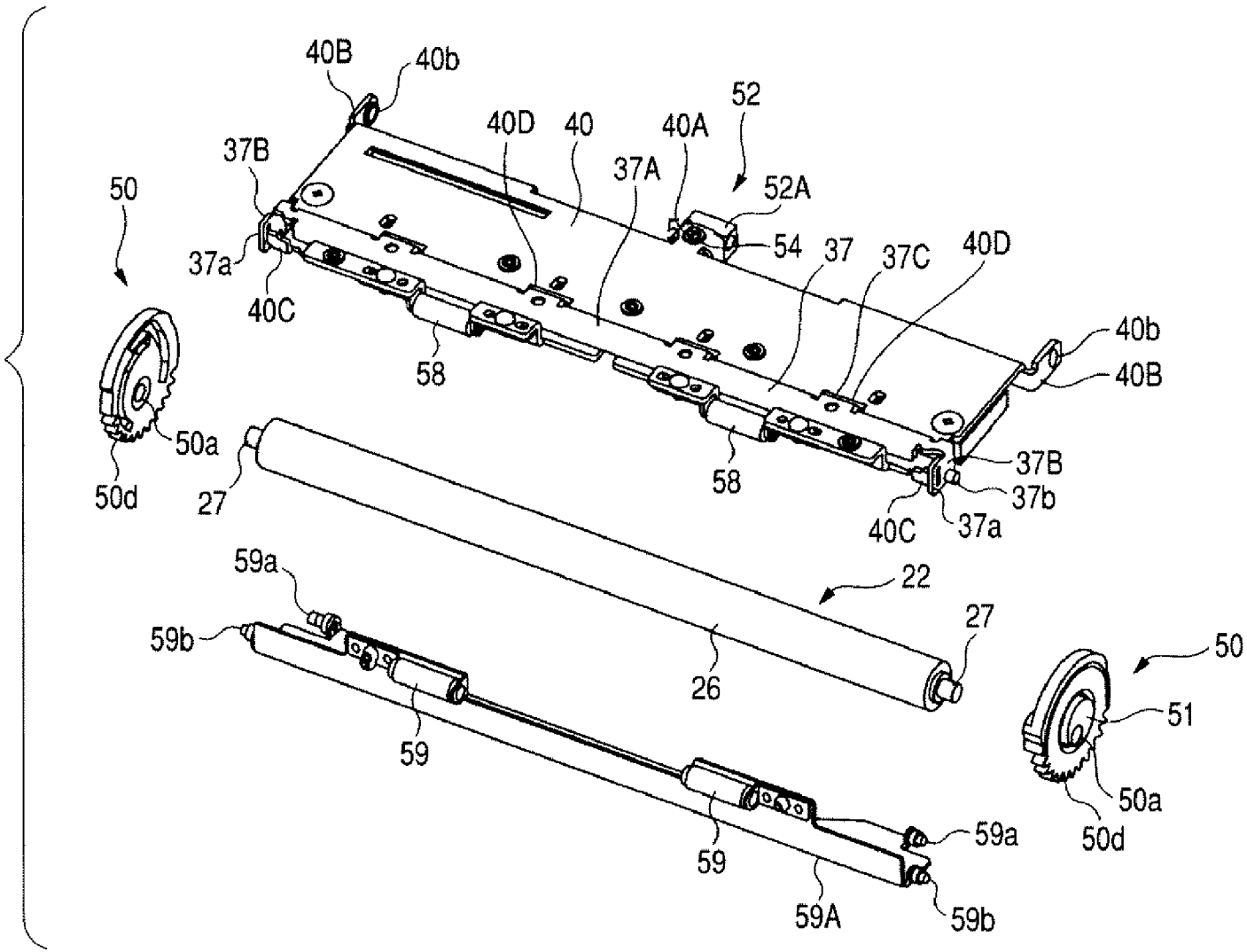
FIG. 3 is an exploded perspective view of FIG. 2.
Figure 4:
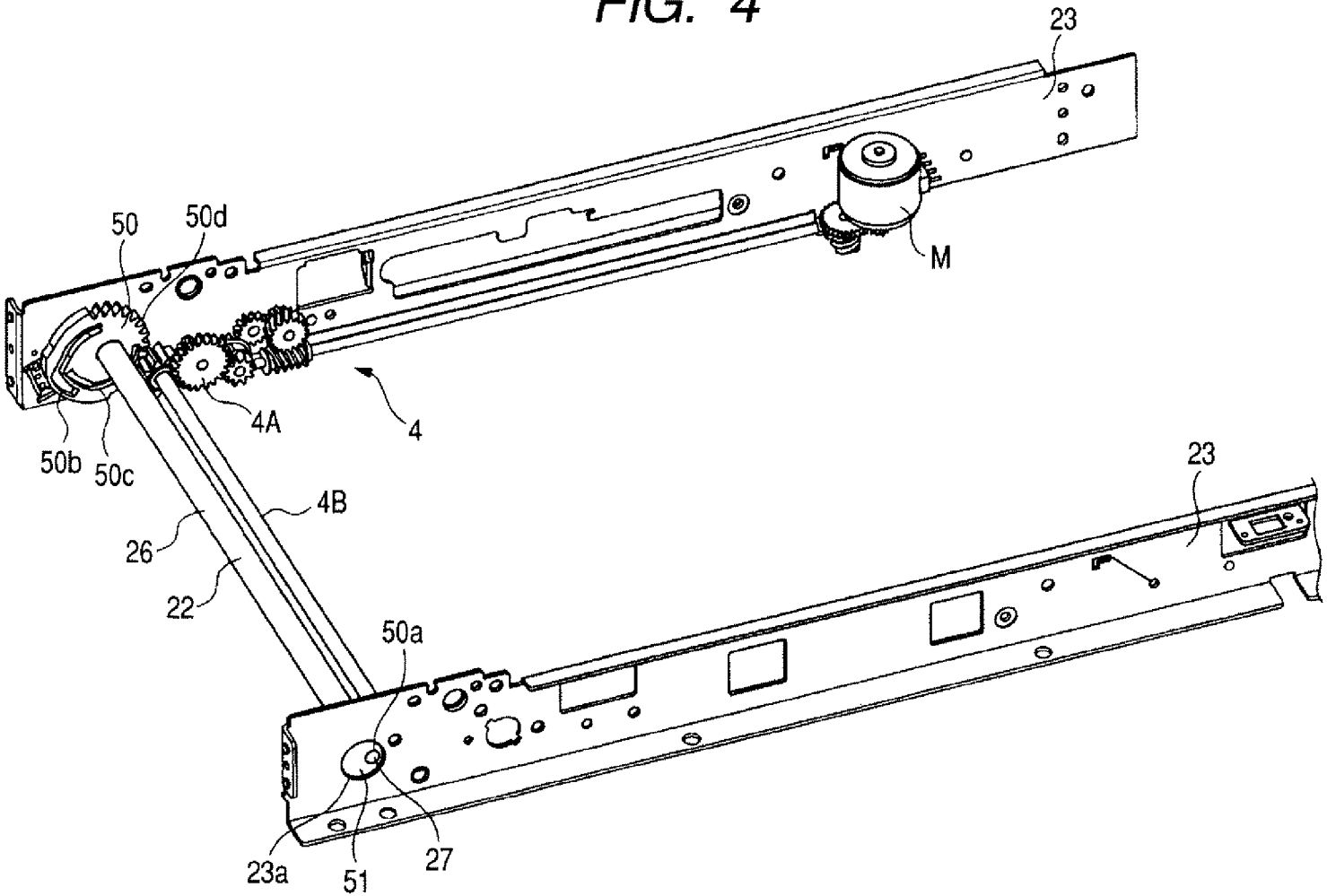
FIG. 4 is a view showing a drive force transmission system of a pressing-separating mechanism of a thermal head of the recording device according to an embodiment of the disclosure.

In this case, as shown in FIGS. 1 to 3, the spring plate 37 may include a long plate-like plate body 37A. The long plate-like plate body may be provided so as to cover the openings of the recesses 42 that are opened at the upper surface of the head lever 40. Side walls 37B, which may be bent toward the bottoms of the recesses 42 so as to extend along the side portions of the head lever 40, may be formed at both ends of the plate body 37A in the longitudinal direction of the plate body. A locking hole 37*a* may be formed at the front end portion of each of the side walls 37B that corresponds to the front surface of the case 3.

Furthermore, locking pieces 40C protruding from a front side wall, which may form the recesses 42 of the head lever 40, toward the both sides are engaged with the locking holes 37*a*. Furthermore, bell crank-like and claw-like locking portions 37C, which may be formed at the rear side opposite to the front surface of the plate body 37A and are bent downward, may be engaged with corresponding engagement portions 40D that are formed on the upper surface of the head lever 40. Accordingly, the spring plate 37 may be fixed to the head lever 40. In this embodiment, the locking hole 37*a* may be formed of a long hole that may be longer than the locking piece 40C to be engaged with the locking hole and extends in a vertical direction. Additionally, the claw-like locking portions 37C may be formed at four positions on the plate body at regular intervals so as to correspond to the positions of the coil springs 39.

In addition, cam roller pins 37*b* for head protrude outward from the side walls 37B. Furthermore, the cam roller pins 37*b* for head may be engaged with cam grooves 50*b* for head that may be formed at a pair of cam gears 50 to be described below. When the cam roller pins for head slide in the cam grooves 50*b* for head in accordance with the rotation of the cam gears 50, the head lever 40 may be swung so that the thermal head 21 is pressed against the platen 22 (head-down) or separated from the platen (head-up).

A pressing (head-down)-separating (head-up) mechanism of the thermal head 21 will be described below.

First, the pair of cam gears 50 will be described. The shaft-like protrusion 51 where the shaft portion 27 of the platen 22 is fixed to the shaft hole 50*a* as described above may be fitted to the shaft hole 23*a* formed at the side plate 23, so that the cam gears 50 may be disposed at both side plates 23, respectively. Furthermore, the torque of a drive motor (head UD (up-and-down) motor) M disposed on an inner surface of one side plate 23 may be transmitted to the pair of cam gears 50 through a transmission system 4, which may include a plurality of gears and drive shafts rotatably provided in the case 3, as a drive force. Accordingly, the cam gears 50 may be rotated in synchronization with each other. Meanwhile, the transmission system 4, which includes at least one gear meshing with the other cam gear 50, may be disposed on an inner surface of the other side plate. One gear that forms the transmission system of the one cam gear (i.e., a gear 4A directly before a gear meshing with one cam gear 50) may be connected to a gear that corresponds to the one gear and forms a transmission system of the other cam gear 50, by one shaft 4B. Accordingly, the torque of one head UD motor M may be transmitted to the pair of cam gears 50, and the cam gears 50 may be rotated in synchronization with each other.

Furthermore, a gear portion 50*d*, which meshes with the gear of the transmission system for transmitting the torque of the head UD motor M, may be formed at each of the cam gears 50 as shown in FIG. 5. The cam grooves 50*b* for head, which may be engaged with the cam roller pins 37*b* for head formed at the spring plate 37, may be formed on the surfaces of the cam gears 50 facing each other.

The cam groove 50*b* for head may include an area that may hold the cam roller pin 37*b* for head at one end of the cam groove 50*b* for head so that the thermal head 21 is in a head-up state (an area positioned above the center of rotation of the cam gear 50 in FIG. 5. Hereinafter, referred to as a head-up area HUA), an area that holds the cam roller pin for head at the other end of the cam groove 50*b* for head so that the thermal head 21 is in a head-down state (an area positioned slightly above the center of rotation of the cam gear 50 in FIG. 5. Hereinafter, referred to as a head-down area HDA), and a gently inclined connecting portion CA that connects the head-up area HUA with the head-down area HDA. When the cam gear 50 is rotated by an angle of about 160°, the cam roller pin 37*b* for head may slide in the cam groove 50*b* for head between one and the other ends of the cam groove for head. Meanwhile, the head-down area HDA of the cam groove 50*b* for head may be inclined so that the thermal head may be gradually moved down toward the other end of the cam groove for head.

Also, the cam grooves 50*c* for roller, which may be engaged with the cam roller pins 59*b* for roller formed at the support arm 59A of the lower holding roller 59, may be formed on the surfaces of the cam gears 50 facing each other.

The cam groove 50*c* for roller may include an approach area AA that may be formed at one end of the cam groove 50*c* for roller, a separation area BA that may be formed at the other end of the cam groove, and a connecting portion CA that may connect with the approach area with the separation area. When the cam gear 50 is rotated by an angle of about 160°, the cam roller pin 59*b* for roller may slide in the cam groove 50*c* for roller.

Figure 5B:
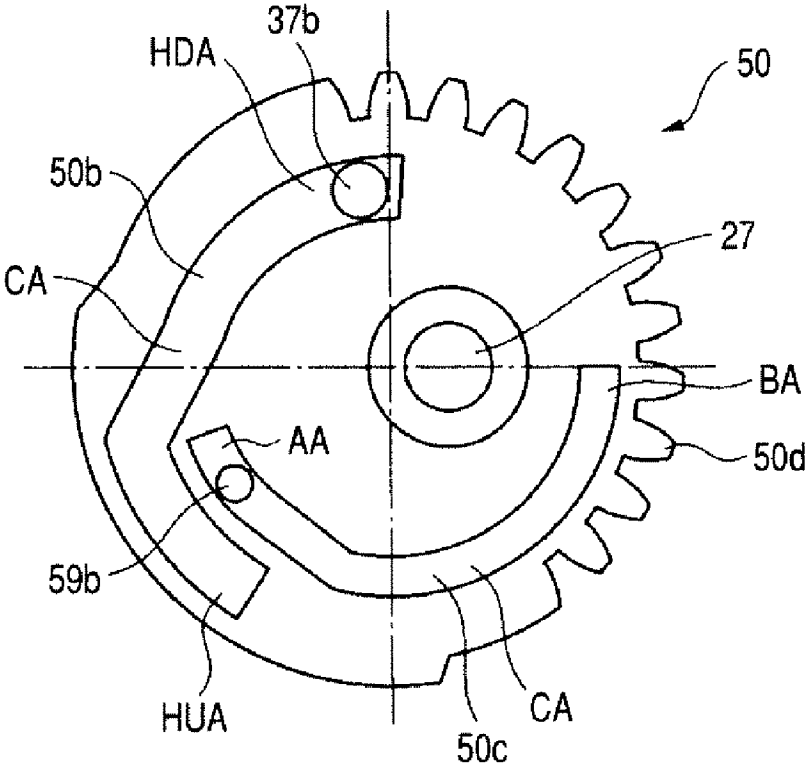
FIG. 5B shows a head-down state of the cam gear.

When the cam gears 50 are rotated and the axis of the platen 22 inserted into the shaft holes 50*a* is moved toward the highest position (substantially the same height as the center of rotation of the cam gear 50 in FIG. 5B), the cam roller pin 37*b* for head may be positioned at the head-down area HDA and the cam roller pin 59*b* for roller may be positioned at the approach area AA of the cam groove 50*c* for roller. That is, when the platen 22 approaches the thermal head, the front end of the head lever 40 may be swung downward and the thermal head 21 maybe in a head-down state. Specifically, if the cam roller pin 37*b* for head is moved from the connecting portion CA of the cam groove 50*b* for head to the connecting portion CA of the head-down area HDA, the thermal head 21 and the optical disk D may come in contact with each other. If the cam roller pin 37*b* for head is moved to an inner portion of the head-down area HDA of the cam groove 50*b* for head, the pressing load of the thermal head 21 applied to the optical disk D may be adjusted to be increased. Moreover, the lower holding roller 59 may be moved to approach the upper holding roller 58.

Figure 5A:
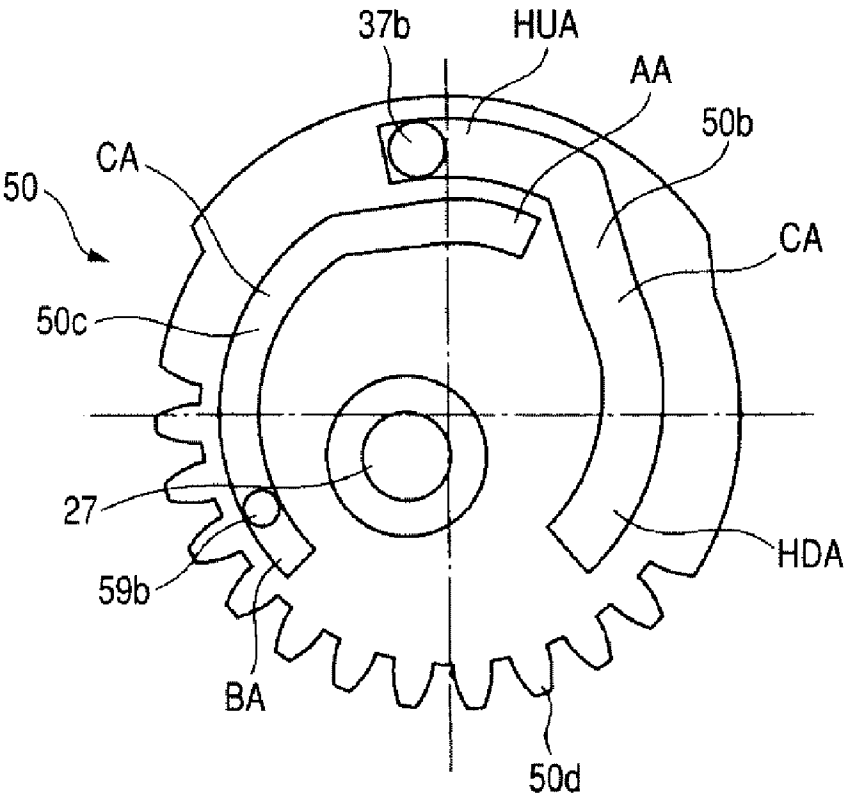
FIG. 5A shows the left side of a cam gear of FIGS. 2 and 3 and a head-up state of the cam gear shown in FIG. 4

In contrast, when the cam gears 50 are rotated and the axis of the platen 22 inserted into the shaft holes 50*a* is moved toward the low position as shown in FIG. 5A, the cam roller pin 37*b* for head may be moved to the head-up area HUA and the cam roller pin 59*b* for roller may be moved to the separation area BA of the cam groove 50*c* for roller. That is, when the platen 22 is separated from the thermal head, the front end of the head lever 40 may be swung upward, the thermal head 21 is in a head-up state, and the lower holding roller 59 may be moved to be separated from the upper holding roller 58.

As for the pressing-separating mechanism of the thermal head 21, when the cam roller pins 37*b* for head slide in the cam grooves 50*b*, the head lever 40 may be swung about the base end portion 40A thereof through the spring plate 37 where the cam roller pins 37*b* for head are formed. The locking hole 37*a* formed at the spring plate 37 may be formed of a long hole that may be longer than the locking piece 40C to be engaged with the locking hole and may extend in a vertical direction. Accordingly, if the locking piece 40C is moved in the locking hole 37*a* when the head lever 40 is swung so that the thermal head 21 is pressed against the platen or is separated from the platen, the distance between the bottom of the recess 42 and the spring plate 37 coming in contact with the upper surface of the coil spring 39 may be changed. Therefore, the coil spring 39 may be elongated or contracted, so that it may be possible to adjust the pressing load of the thermal head 21 even by the elongation and contraction of the coil spring 39.

During a printing operation that is performed according to a print signal to be described below, the thermal head 21 and the platen 22 approach each other, an optical disk D may be pinched between the thermal head and the platen, the platen 22 may be driven to rotate in accordance with recording, and the optical disk D may be transported and discharged by the pressing-separating mechanism of the thermal head 21. However, the thermal head and the platen are positioned to be separated from each other in a case except for this case.

Furthermore, the recording device 1 may be provided with first and second sensors (not shown) that may detect the presence or absence of the optical disk D to be transported. The first sensor may be provided in the middle of the transport path in the width direction of the transport path directly before the position of the thermal head 21 of the recording device 1 that is an upstream side (a side close to the optical disk drive mechanism) in the transport direction at the time of an ejecting operation for discharging the optical disk D to the outside of the case 3 from the slot 2. Furthermore, the second sensor may be provided in the middle of the transport path in the width direction of the transport path directly behind the position of the thermal head 21. Since the first and second sensors may be provided in the middle of the transport path in the width direction of the transport path as described above, it may be possible to reliably detect the front or rear end portion of a disk-shaped optical disk that is transported in the middle of the transport path. Furthermore, a reflective sensor having known structure where a light emitting part may be integrally formed with a light receiving part may be used as each of the first and second sensors, the first sensor may be fixed to the spring plate 37 through a sensor substrate, the second sensor may be fixed to the thermal head 21 through a sensor substrate, and the first and second sensors may face the label surface DL of the optical disk D. Accordingly, it maybe possible to keep an appropriate distance between the first and second sensors and the surface of the optical disk D and to perform stable sensing.

Additionally, the recording device 1 may include a control unit that may control the driving of the optical disk drive mechanism 10 and the driving of the recording device 1. The control unit may generate and send signals to at least the optical disk drive mechanism 10 and the recording device 1 on the basis of the operation that is input by a user. For example, the control unit may be a CPU.

Figure 6:
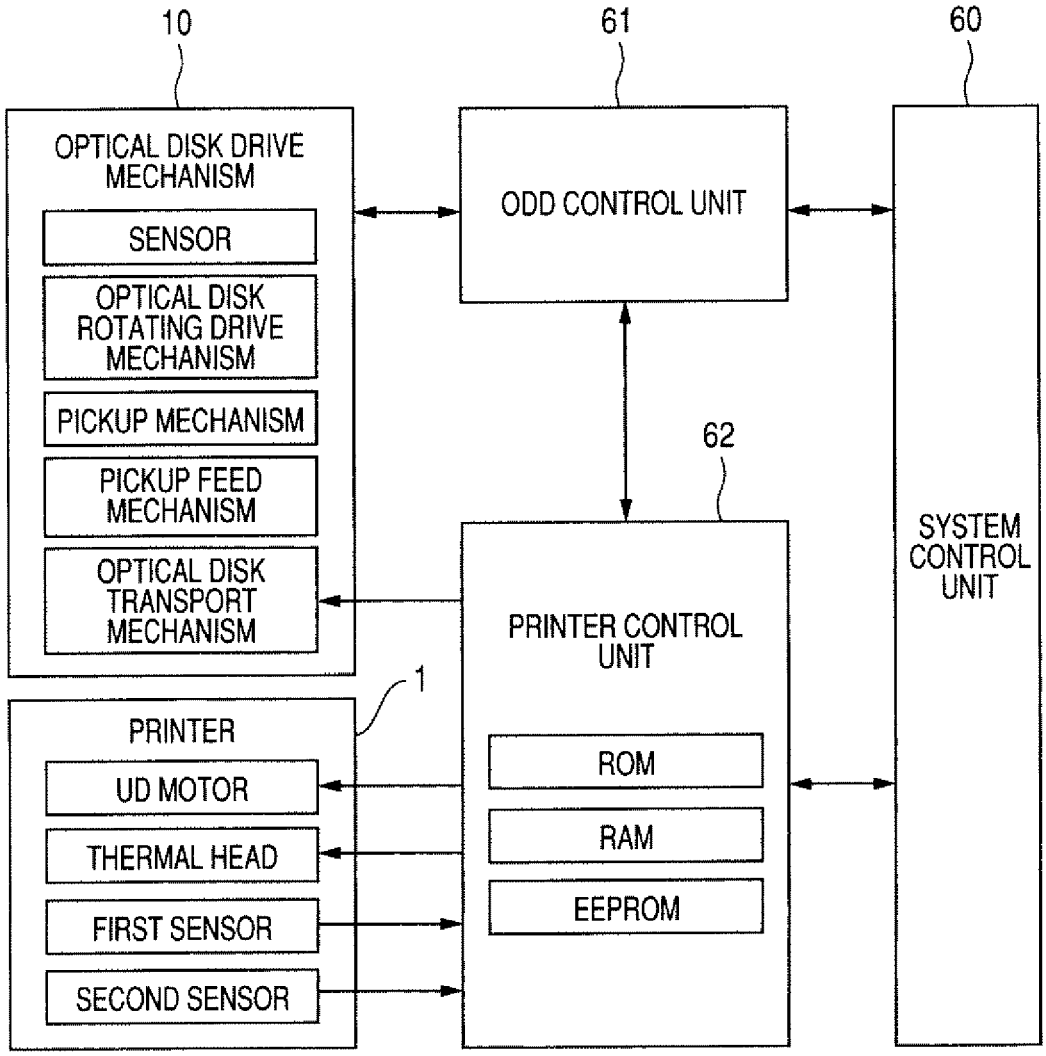
FIG. 6 is a block diagram of a control system of the recording device according to an embodiment of the disclosure.

FIG. 6 is a block diagram of a exemplary control system of the recording device 1. The control unit of the recording device 1 may use a CPU of an electronic device, which may be assembled with the recording device 1, as a system control unit 60. The system control unit 60 may be connected to an ODD control unit 61 that may control the driving of the optical disk drive mechanism 10 and a printer control unit 62 that may control the driving of the recording device, through a control board 6. Furthermore, the system control unit 60 and the printer control unit 62 also may be connected to each other so as to interchange data.

Meanwhile, the ODD control unit 61 may control the driving of the optical disk rotating drive mechanism, the pickup mechanism, the pickup feed mechanism, and the optical disk transport mechanism. Furthermore, specifically, the printer control unit 62 may control the determination of the detection of the optical disk D that is performed by the first and second sensors, the flow of current applied to the heating elements of the thermal head 21, the rotational driving of the cam gears 50 that make the pressing/separation operation of the thermal head 21 be linked, and the rotational driving of the platen 22. Furthermore, the printer control unit may control the driving of the optical disk transport mechanism of the optical disk drive mechanism 10 through the ODD control unit 61. In particular, the rotational driving of the cam gears 50, which make the pressing/separation operation of the thermal head 21 be linked, may be controlled so that the pressing load of the thermal head 21 is frequently adjusted according to the contact length of the label surface DL, which may come in contact with the heating elements, of the transported optical disk D.

Moreover, a thermosensitive recording medium for color recording having known structure, where a plurality of color-developing layers developing colors by heating in different temperature ranges may be provided on a base material formed of a transparent sheet, may be attached to the label surface DL serving as a concentric printing surface, which is concentric with the optical disk D, of the optical disk D that is used in this embodiment. For example, a sheet-like thermosensitive recording medium disclosed in PCT Japanese Translation Patent Publication No. 2004-530576 or Japanese Unexamined Patent Application Publication No. 2002-370455 (the contents of each are hereby incorporated by reference) may be used as the thermosensitive recording medium.

The control and driving of the recording device 1 according to various embodiments will be described below.

In the control and driving of the recording device 1, the printing on the label surface DL of the circular optical disk D may be performed at the time of the ejecting operation that discharges the optical disk D to the outside of the case 3 from the inside of the case 3. Accordingly, when a desired image is printed by the recording device 1, first of all, the optical disk D, which may include a sheet-like thermosensitive recording medium for color recording attached to the label surface DL thereof, should be loaded on the optical disk loading unit in the case 3.

If the printing of a desired image is instructed, the presence or absence of the optical disk D and the size of the optical disk D may be detected first. This detection is performed by using sensors (not shown), which may be provided in the optical disk drive mechanism 10, through the ODD control unit 61.

That is, when a desired image is subsequently printed after a signal is written and/or read out onto/from the optical disk D by using the pickup mechanism of the recording device 1, the optical disk D already may be loaded on the optical disk loading unit. Accordingly, the printer control unit 62 may receive a signal indicating that the optical disk D is loaded and a signal indicating the size of the optical disk, from the ODD control unit 61. Then, the printer control unit may begin to perform the control for printing from this state.

Moreover, when only the printing of a desired image is performed using the recording device 1, various kinds of control may begin to be performed from an operation for loading the optical disk D on the optical disk loading unit. That is, a loading operation that draws the optical disk D into the case 3 from the slot 2 may be performed by using the optical disk transport mechanism through the ODD control unit 61, and the optical disk D may be loaded on the optical disk loading unit. After that, the printer control unit 62 may receive a signal indicating that the optical disk D is loaded and a signal indicating the size of the optical disk, from the ODD control unit 61. Then, the printer control unit may begin to perform the control for printing from this state.

That is, in order to perform printing on the basis of the desired image data, the optical disk transport mechanism of the optical disk drive mechanism 10 may be driven by the control of the printer control unit 62 and an ejecting operation for discharging the optical disk D to the outside of the case 3 from the slot 2 may be performed.

If the front end of the optical disk D, which may be transported toward the slot 2 from the optical disk loading unit, is detected by the second sensor, the states of the thermal head 21 and the platen 22, which may be held in the head-up state, may be changed into the head-down state in order to print a desired image on the basis of the image data. That is, the printer control unit 62 may drive the UD motor M, transmit the torque of the UD motor to the pair of cam gears 50 through a transmission system such as a gear, and rotate the cam gears while making the cam gears synchronize with each other.

When the pair of cam gears 50 is rotated, the platen 22 journaled to the cam gears 50 may be moved along a circular arc toward the thermal head 21. At the same time, the cam roller pins 37*b* for head may be moved in the cam grooves 50*b* for head toward the head-down area HDA. When the head lever 40 is swung downward through the spring plate 37 due to this movement, the thermal head 21 and the platen 22 may approach each other, so that the states of the thermal head and the platen may be changed into the head-down state. Furthermore, the optical disk D, which may be discharged toward the slot 2 along the transport path by the ejecting operation, is pinched between the thermal head 21 and the platen 22, and an operation for transporting the optical disk D by the optical disk transport mechanism may be terminated.

First, if the second sensor detects the position of the front end of the optical disk D, the platen 22 may be rotated in a reverse direction to transport the optical disk D toward the optical disk drive mechanism again so that the printing of a desired image may be performed at an appropriate printing area on the label surface DL of the optical disk D, that is, so-called heading for printing may be performed. Then, the printing of the desired image may begin to be performed.

At that time, the current applied to the corresponding heating elements may be controlled through the control of the system control unit 6C and the printer control unit 62 in accordance with the desired image data, so that the necessary amount of heat may be selectively supplied to the thermal head 21. The sheet-like thermosensitive recording medium, which may be attached to the label surface DL of the optical disk D pressed by the thermal head 21, may develop a color with a desired color tone by the addition of the amount of heat, and the optical disk D may be transported toward the slot 2 while desired printing is performed.

In this case, since the heating elements of the thermal head 21 may be arranged so as to correspond to the length that is equal to or larger than the printing diameter of the label surface of the optical disk D, the position of the thermal head does not need to be changed in an in-plane direction of the optical disk D. Furthermore, the range of flow of current applied to the heating elements may be changed according to the size of the optical disk D.

At that time, the control unit may perform the control for frequently adjusting the pressing load of the thermal head 21 according to the contact length of the label surface DL, which may come in contact with the heating elements, of the optical disk D transported to a printing portion where the thermal head 21 and the platen 22 are pressed against each other. That is, if receiving a signal indicating that the optical disk D is loaded and a signal indicating the size of the optical disk, from the ODD control unit 61, the printer control unit 62 may recognize the size of the optical disk. Accordingly, the printer control unit 62 may adjust the pressing and separation of the thermal head 21 by adjusting the rotation of the cam gear 50 when the head lever 40 is swung according to the contact length of the label surface DL (that is, a printing surface), which may come in contact with the heating elements, of the optical disk D transported to a printing portion, and controlling the position of the cam roller pin 37*b* for head that slides in the cam groove 50*b* for head. Additionally, the printer control unit adjusts the pressing load of the thermal head 21 by the elastic pressing force of the coil spring 39 by moving the locking piece 40C in the locking hole 37*a* so that the distance between the bottom of the recess 42 and the spring plate 37 coming in contact with the upper surface of the coil spring 39 may be changed.

Specifically, if the label surface DL that is a printing surface has a circular shape like in the optical disk D used as a print medium, the linear contact length of the middle portion, which may come in contact with the heating elements of the thermal head 21, of the optical disk in the transport direction is longest (that is, substantially the same as the diameter of the optical disk D) and the linear contact lengths of the frontmost and rearmost portions, which may come in contact with the heating elements of the thermal head 21, of the optical disk in the transport direction may be shortest.

Accordingly, when the front end of the optical disk D reaches the printing portion, the cam gear 50 may be rotated to position the cam roller pin 37*b* for head at the connecting portion CA of the head-down area HDA of the cam groove 50*b* for head so that the pressing load of the thermal head 21 may become minimum. Therefore, the head-down state of the head lever 40 and the elastic pressing force of the coil spring 39 may be adjusted. After that, the cam gear 50 may be rotated until the central portion of the optical disk D reaches the printing portion. Accordingly, the cam roller pin 37*b* for head gradually slides to the innermost portion of the head-down area HDA of the cam groove 50*b* for head, that is, the other end of the cam grooves 50*b* for head. When the central portion of the optical disk D reaches the printing portion, the largest pressing load of the thermal head may be obtained.

After that, the cam roller pin 37*b* for head may gradually slide to the connecting portion of the head-down area HDA of the cam groove 50*b* for head. When the rear end of the optical disk D reaches the printing portion, the rotation of the cam gear 50 may be adjusted so that the pressing load of the thermal head 21 may become the minimum again.

Even though the linear contact length of the optical disk D coming in contact with the thermal head 21 may be changed as described above, it may be possible to change the pressing load of the thermal head 21 and the distance between the platen 22 and the thermal head 21 by adjusting the rotation of the cam gear 50 in accordance with the transportation of the optical disk D. Accordingly, it may be possible to keep the contact pressure substantially constant and to obtain good recording results on the label surface DL of the optical disk D.

Meanwhile, in order to adjust the rotation of the cam gear 50, data, which considers the shape of the label surface DL of the optical disk D and is used for driving the cam gear 50, may be previously stored in the printer control unit 62, and the UD motor M may be driven in a normal or reverse direction on the basis of the data in accordance with the predetermined number of steps.

Additionally, after the printing of a desired image is terminated, the optical disk D may be transported toward the optical disk drive mechanism again and may be received on the transport path while the front end of the optical disk D protrudes from the slot 2.

Furthermore, the UD motor M is driven, the pair of cam gears 50 is rotated, the platen 22 may be moved to be separated from the thermal head 21, and the head lever 40 may be pushed up through the spring plate 37.

While the front end of the optical disk D on which a desired image has been printed protrudes from the slot 2, the optical disk may be pinched by the upper holding roller 58 and the lower holding roller 59 on the transport path. Accordingly, when a user grips the front end of the optical disk D and draws the optical disk from the slot 2 while rotating the upper and lower holding rollers 58 and 59, the user can obtain the optical disk D on which the desired image has been printed.

Meanwhile, when a signal is intended to be written and/or read out onto/from another optical disk D or a desired image is intended to be printed on another optical disk, another optical disk may be sent from the slot 2 onto the transport path formed between the thermal head 21 and the platen 22 that are positioned to be separated from each other in the head-up state. When the front end of the optical disk D reaches the optical disk loading unit of the optical disk drive mechanism 10, the sensor provided in the optical disk drive mechanism 10 may detect the front end of the optical disk. The ODD control unit 61 may receive a detection signal and drive the optical disk transport mechanism, so that the optical disk may be properly loaded on the optical disk loading unit.

Meanwhile, the reverse transportation at the time of the above-mentioned heading of the optical disk D, the normal transportation of the optical disk D at the time of printing, or the reverse transportation that is performed to hold the optical disk D after the termination of printing may be determined by the printer control unit 62 in consideration of the size of the optical disk D to be supplied from the ODD control unit 61, and may be performed on the basis of the number of managed steps.

Since the recording device 1 may be integrally formed with the slot-in type optical disk drive mechanism 10 as described above, the recording device 1 does not need to separately include a transport mechanism for transporting an optical disk D and may be formed to have compact structure. In addition, it may be possible to also print an image on the label surface DL of the optical disk D well through one-time ejecting transportation of the optical disk D.

Meanwhile, the invention is not limited to the above-mentioned embodiment, and may have various modifications when necessary.

For example, the print medium is not limited to a circular object such as an optical disk. If the print medium has different shapes having portions where the contact lengths of a printing surface coming in contact with the heating elements in a width direction orthogonal to a transport direction of a print medium are different in the transport direction, the significant effect of the invention may be obtained. For example, a print medium, which has the shape of a star or heart in plan view, may be used. In this case, the shape of the printing surface may be a rectangular shape. The reason for this is that the invention is not to adjust the pressing force applied to the printing area but to make the pressing force, which is applied to the printing surface of the thermal head, be uniform.

Moreover, the recording device has been integrally formed with the optical disk drive mechanism and a desired image has been printed on the label surface of the optical disk that is transported by a transport means provided in the optical disk drive mechanism. However, a transport mechanism (which may have known structure) for transporting a recording medium may be provided in the recording device, and desired printing may be performed on the recording medium transported by the transport mechanism while the pressing load of the thermal head is changed by controlling the pressing and separation of the thermal head as described above.

It should be understood by those skilled in the art that various modifications, combinations, sub-combinations and alterations may occur depending on design requirements and other factors insofar as they are within the scope of the appended claims of the equivalents thereof.

Accordingly, the embodiments of the present inventions are not to be limited in scope by the specific embodiments described herein. Further, although some of the embodiments of the present invention have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A recording device that presses a thermal head, comprising a printing portion and a printer controlling section, where heating elements are arranged in a direction orthogonal to a transport direction of a print medium, against a printing surface of the print medium at the printing portion on a transport path of a print medium transported by a transport means, controls the flow of current selectively applied to the heating elements, and performs desired printing at a printing area on the printing surface, wherein the print medium has a shape having portions where contact lengths of the printing surface coming in contact with the heating elements in a width direction orthogonal to a transport direction of the print medium are different in the transport direction, and the printer controlling section frequently adjusts a pressing load of the thermal head according to the contact length of the printing surface of the print medium and controls rotation of cam gears that make pressing/separation operation of the thermal head be linked as well as detection of a size of the print medium.

2. The recording device according to claim 1, wherein the print medium is a circular optical disk, and the printing surface of the print medium has a circular shape that is concentric with the print medium.

3. The recording device according to claim 2, wherein the recording device is integrally formed with an optical disk drive mechanism, and prints a desired image on a label surface of an optical disk that is transported by a transport means provided in the optical disk drive mechanism.

* * * * *